US009404343B2

(12) United States Patent
Themig et al.

(10) Patent No.: US 9,404,343 B2
(45) Date of Patent: Aug. 2, 2016

(54) WIRELINE CONVEYED APPARATUS FOR WELLBORE FLUID TREATMENT

(75) Inventors: Daniel Jon Themig, Calgary (CA); James Fehr, Sherwood Park (CA); Serhiy Arabsky, Beaumont (CA)

(73) Assignee: PACKERS PLUS ENERGY SERVICES INC., Calgary (CA)

( * ) Notice: Subject to any disclaimer, the term of this patent is extended or adjusted under 35 U.S.C. 154(b) by 489 days.

(21) Appl. No.: 13/877,758

(22) PCT Filed: Oct. 4, 2011

(86) PCT No.: PCT/CA2011/001121

§ 371 (c)(1), (2), (4) Date: Apr. 4, 2013

(87) PCT Pub. No.: WO2012/045156

PCT Pub. Date: Apr. 12, 2012

(65) Prior Publication Data

US 2013/0199790 A1 Aug. 8, 2013

Related U.S. Application Data

(60) Provisional application No. 61/390,086, filed on Oct. 5, 2010.

(51) Int. Cl.

| | |
|---|---|
| ***E21B 33/12*** | (2006.01) |
| ***E21B 43/26*** | (2006.01) |
| ***E21B 34/14*** | (2006.01) |
| ***E21B 23/14*** | (2006.01) |
| ***E21B 33/124*** | (2006.01) |
| ***E21B 43/14*** | (2006.01) |
| *E21B 34/00* | (2006.01) |

(52) U.S. Cl.
CPC ..... *E21B 34/14* (2013.01); *E21B 23/14* (2013.01); *E21B 33/124* (2013.01); *E21B 43/14* (2013.01); *E21B 2034/007* (2013.01)

(58) Field of Classification Search
CPC ..... E21B 2023/008; E21B 2134/007; E21B 34/14; E21B 43/14; E21B 33/124; E21B 23/14; E21B 23/14
USPC ..... 166/305.1, 192, 194
See application file for complete search history.

(56) References Cited

U.S. PATENT DOCUMENTS 2,999,545 A 9/1961 Bigelow
4,729,429 A 3/1988 Wittrisch
(Continued)

FOREIGN PATENT DOCUMENTS

WO WO 92/09784 6/1992

*Primary Examiner* — Michael Wills, III
(74) *Attorney, Agent, or Firm* — Bennett Jones LLP

(57) ABSTRACT

A wellbore treatment apparatus includes: a tubing string including a wall defining an inner diameter and a port extending through the wall, the port closed by a closure including a plug-actuated sliding sleeve; and a port opening apparatus including a wireline deployable through the inner diameter of the tubing string to extend to a position adjacent the plug-actuated sliding sleeve and an actuator plug carried on and axially slideable along the wireline, the actuator plug sized to land in the plug-actuated sliding sleeve to actuate the plug-actuated sliding sleeve, while remaining on the wireline. The apparatus can be employed in a method by running the tubing string into a well, placing the slickline in the string and running the actuator plug along the wireline to land on and actuate a sleeve in the string.

29 Claims, 3 Drawing Sheets

(56) References Cited

U.S. PATENT DOCUMENTS

| | | | |
|---|---|---|---|
| 4,940,094 | A | 7/1990 | Lessi et al. |
| 5,180,009 | A | 1/1993 | Sneed |
| 5,957,206 | A | 9/1999 | Patel |
| 7,387,165 | B2 | 6/2008 | Lopez De Cardenas et al. |
| 7,513,311 | B2 | 4/2009 | Gramstad et al. |
| 7,543,636 | B2 | 6/2009 | Malone et al. |
| 2006/0157257 | A1 | 7/2006 | Ross et al. |
| 2010/0108323 | A1 | 5/2010 | Wilkin |

WIRELINE CONVEYED APPARATUS FOR WELLBORE FLUID TREATMENT

FIELD

A method and apparatus for wellbore fluid treatment is disclosed.

BACKGROUND

Processes and apparatus are known for fracturing a well through a ported tubing string run into the well. In some cases, a method is required for quickly and efficiently installing and opening ports in a wellbore tubing string.

Using one of the systems as described in prior U.S. Pat. No. 6,907,936, it might be required to install the string and open the ports quickly.

For example, in some drilling campaigns, a number of wells are drilled and it is desirable to place the wells on production quickly in order to assess performance and allow some revenue. It is desired to place the treatment or production strings in the well, but there is insufficient time treat the well. Thus, although the well may be returned to later for stimulation or other treatments, the process requires that the sleeves be opened quickly along the string.

As such it is desirable to provide a method where a tubing string system, such as one described in U.S. Pat. No. 6,907,936, including a plurality ports each covered by a sleeve with a different sized plug seat, is installed and all of the plurality of the ports are opened quickly to put the well on production.

SUMMARY

In one embodiment, there is provided a wellbore treatment apparatus comprising: a tubing string including a wall defining an inner diameter and a port extending through the wall, the port closed by a closure including a plug-actuated sliding sleeve; and a port opening apparatus including a wireline deployable through the inner diameter of the tubing string to extend to a position adjacent the plug-actuated sliding sleeve and an actuator plug carried on and axially slideable along the wireline, the actuator plug sized to land in the plug-actuated sliding sleeve to actuate the plug-actuated sliding sleeve, while remaining on the wireline.

In another aspect of the invention, there is provided a method for fluid treatment of a wellbore, the method comprising: running a tubing string into a wellbore to a desired position for treating the wellbore, the tubing string including an inner diameter, a port and a closure including a sliding sleeve, the closure being in a closed port position over the port; running a wireline into the tubing string inner diameter to at least a position reaching the sliding sleeve; conveying an actuator plug along the wireline to land in the sliding sleeve such that the sliding sleeve is moved by the actuator plug landing therein to open the port; and forcing wellbore treatment fluid out through the port to treat the well.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

Figure 1A:
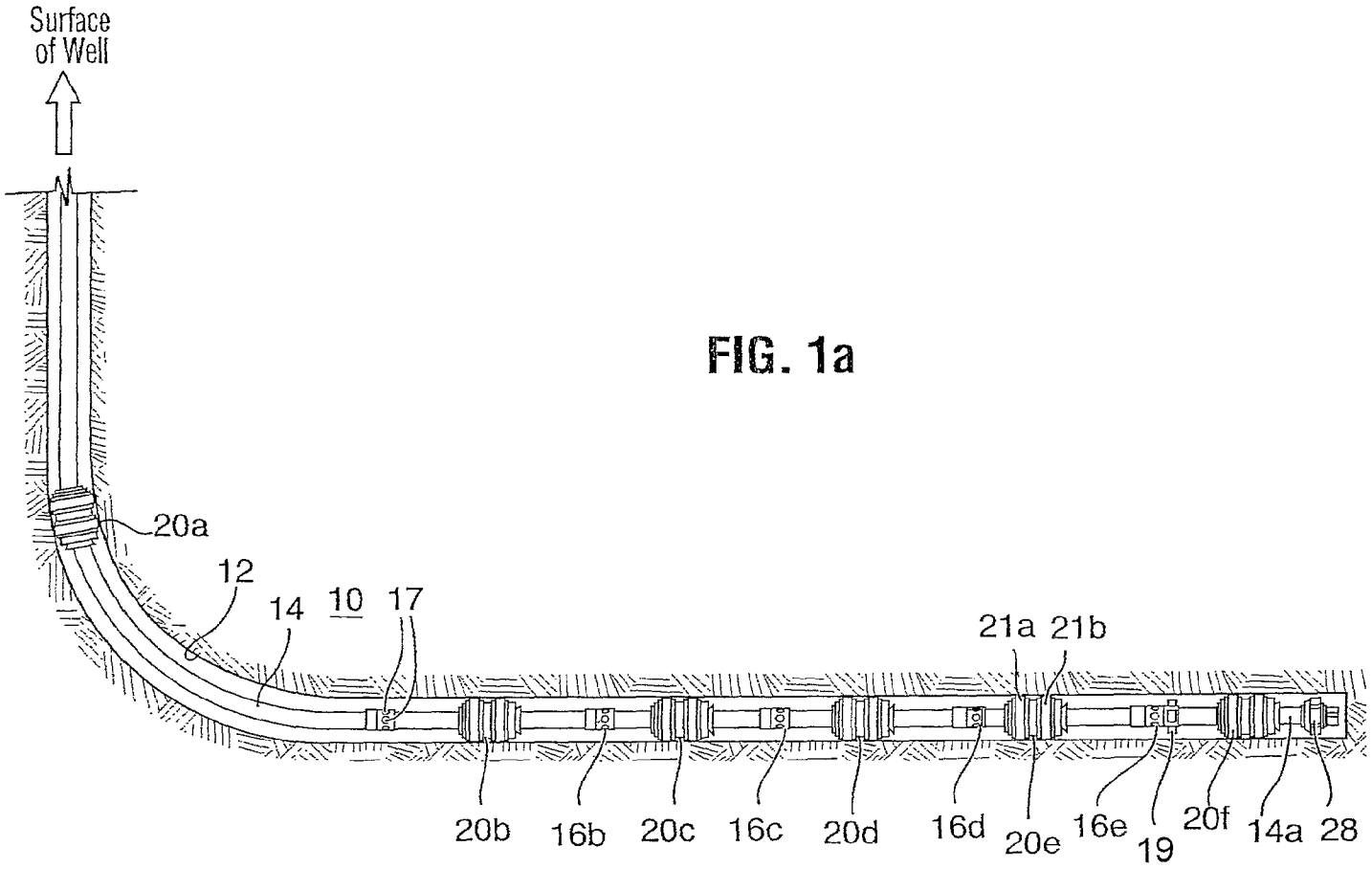
FIG. 1*a* is a sectional view through a wellbore having positioned therein a fluid treatment assembly.

The description that follows, and the embodiments described therein, is provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

The method and apparatus allow a fast and efficient way to open a plurality of ports in a wellbore treatment string. After the ports have been opened, the opening apparatus can be quickly retrieved from the well.

The apparatus and method according to the present invention employs a wellbore treatment apparatus including a tubing string with a port extending through the tubing string wall. The port is closed by a closure including a plug-actuated sliding sleeve. The apparatus employs an actuator plug to open the port and, in particular, a port opening apparatus including wireline used to support the actuating plug for opening the sleeve. The actuator plug is carried on the wireline and is moveable therealong for conveyance downhole to actuate the sleeve, while remaining on the wireline. The actuator plug may be described as being "threaded" on the wireline, as in a "ball on a string". In particular, the plug may have a hole therethrough through which the wireline passes. The plug is thus retained on the wireline, but may slide along the wireline as the wireline passes through the hole.

The tubing string may include further ports having closures with sliding sleeves and the wireline may carry further actuator plugs to actuate those sleeves. While the lowest actuator plug (i.e the one closest to the distal end of the wireline) may be fixed, the remaining actuator plugs are moveable along the wireline for conveyance downhole to actuate the sleeves.

In one embodiment, for example, there is provided an apparatus for fluid treatment of a borehole, the apparatus comprising a tubing string having a long axis, a first port opened through the wall of the tubing string, a second port opened through the wall of the tubing string, the second port offset from the first port along the long axis of the tubing string, a first sleeve positioned relative to the first port, the first sleeve being moveable relative to the first port between a closed port position and a position permitting fluid flow through the first port from the tubing string inner bore and a second sleeve being moveable relative to the second port between a closed port position and a position permitting fluid flow through the second port from the tubing string inner bore, the second sleeve including a seat formed thereon; and a port opening apparatus including a wireline and an actuator plug threaded on the wireline and axially moveable along the wireline for landing on the seat of the second sleeve and for moving the second sleeve from the closed port position to the position permitting fluid flow. The actuator plug is selected to land on the seat and create a seal in the tubing string against fluid flow past the second sleeve through the tubing string inner bore, such that fluid pressure can be applied to move the second sleeve.

In particular, after the actuating plug lands on the second sleeve a seal is formed by the actuator plug and the seat, such that fluid pressure applied generates a pressure differential to move the second sleeve.

The actuator plug for moving the second sleeve can be selected to move the second sleeve without also moving the first sleeve. In one such embodiment, the actuator plug is selected to move past the first sleeve on its way to the second sleeve and, when passing, the actuator plug fails to move the first sleeve to its open position. However, the first sleeve may also have formed thereon a seat and the port opening apparatus may include an actuator plug for the first sleeve, which is selected to move axially along the wireline until it reaches the first seat and then seal against the seat of the first sleeve. In the same way as that for the second sleeve, if the actuator plug for the first sleeve is seated against the seat of that sleeve, fluid pressure can be applied to move the first sleeve. In such an embodiment, however, the seat of the first sleeve has a larger diameter than the second seat, such that the actuator plug for the second sleeve can move past the first sleeve without sealing thereagainst to reach and seal against the seat of the second sleeve. The actuator plugs are graduated in size. For example, the actuator plug for the lowermost seat in the well has the smallest diameter with the actuator plugs for seats thereabove being progressively larger.

In the closed port position, the sleeves can be positioned over their ports to close their ports against fluid flow therethrough. In such an embodiment, moving the sleeve away from an overlapping position over the port opens the port.

In another embodiment, the port is closed by a subclosure and the sleeve is positioned adjacent or over the subclosure and acts against the subclosure to open the port. The port, for example, may have mounted thereon a cap accessible from the tubing string inner bore. In the closed port position, the cap covers the port and in the position permitting fluid flow, the sleeve has engaged against and opened the cap. The cap can be opened, for example, by action of the sleeve breaking open, including removing, the cap from its position over the port.

In another embodiment, the port subclosure may be a secondary sliding sleeve. For example, the port may have mounted thereover a secondary sliding sleeve and in the position permitting fluid flow, the first sleeve has engaged and moved the secondary sliding sleeve away from the first port. The sliding sleeve can include, for example, a groove and the first sleeve includes a locking dog biased outwardly therefrom and selected to lock into the groove on the secondary sliding sleeve.

Each closure sleeve may open one or more ports. In some embodiments, there is a plurality of closely grouped ports over which the sleeve acts. In embodiments where the sleeve moves to open a subclosure, there may be a plurality of spaced apart ports with subclosures and the sleeve moves axially along the tubing string to open them.

In one embodiment, the tubing string may carry a plurality of annular packers extending thereabout to create isolatable zones along the well. For example, any port may have a pair of packers straddling it. For example, the apparatus described above including two spaced apart ports may include a first packer about the tubing string operable to seal about the tubing string and mounted on the tubing string to act in a position offset from the first port along the long axis of the tubing string, a second packer operable to seal about the tubing string and mounted on the tubing string to act in a position between the first port and the second port along the long axis of the tubing string; a third packer operable to seal about the tubing string and mounted on the tubing string to act in a position offset from the second port along the long axis of the tubing string and on a side of the second port opposite the second packer. The packers can be of any desired type to seal between the wellbore and the tubing string. In one embodiment, at least one of the first, second and third packer is a solid body packer including multiple packing elements. In such a packer, it is desirable that the multiple packing elements are spaced apart.

As noted above, the tubing string apparatus is used with a port opening apparatus, which includes the sleeve actuating plugs carried on a wireline. The actuator plugs are carried on the wireline and, except possibly for the first required actuator plug, can slide therealong. The actuator balls are threaded onto the slickline and conveyed downhole for actuating the sleeves. For example, with reference to the above-described tubing string, the wireline may have a first actuator plug positionable thereon that is selected to actuate the second sleeve and another actuator plug moveably positionable thereon that is selected to actuate the first sleeve.

With respect to moveable plugs, each plug may include a bore therethrough through which it may be threaded onto the wireline. The wireline may be inserted through the bore of the plug and the plug may be slid along the wireline. The wireline can be deployed in the well and the actuator plugs can be conveyed into the well by riding along the wireline.

Various types of wireline may be employed such as e-line, braided line, slickline, etc. Slickline is lightweight and durable and provides an economical and easy line option and the invention description will follow with reference to slickline, but it is to be understood that other types of wireline may also be of interest.

Actuating plugs may take various forms such as darts, balls, etc. In the following description, reference may be made to balls, but "balls" is to be understood to refer to all conveyable plugs.

In view of the foregoing there is provided a method for fluid treatment of a borehole, the method comprising: running a tubing string into a wellbore in a desired position for treating the wellbore; running a wireline into the tubing string inner diameter to at least a position reaching a sleeve in the tubing string to be actuated; conveying an actuator ball along the wireline to land in the sleeve to be actuated to open a port closed by the sleeve; and forcing wellbore treatment fluid out through the opened port to treat the well.

In one method according to the present invention, the fluid treatment is borehole stimulation using stimulation fluids such as one or more of acid, water, oil, $CO_2$ and nitrogen, any of which can contain proppants, such as for example, sand or bauxite. The method can be conducted in an open hole or in a cased hole. In a cased hole, the casing may have to be perforated prior to running the tubing string into the wellbore, in order to provide access to the formation.

The method may include setting packers about the tubing string to create isolated zones along the wellbore annulus, generally before opening the port. In an open hole, preferably, the packers include solid body packers including a solid, extrudable packing element and, in some embodiments, solid body packers include a plurality of extrudable packing elements.

Figure 1B:
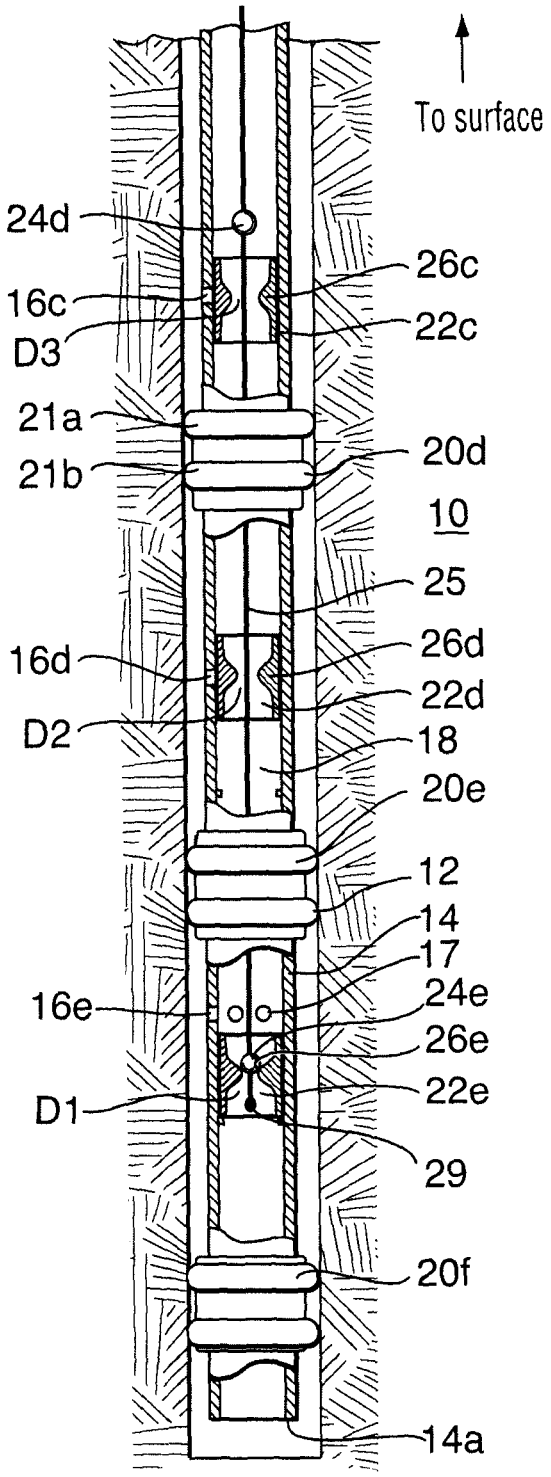
FIG. 1*b* is an enlarged view of a portion of the wellbore of FIG. 1*a* with the fluid treatment assembly also shown in section.

Referring to FIGS. 1*a* and 1*b*, a wellbore fluid treatment assembly is shown, which can be used to effect fluid treatment of a formation 10 through a wellbore 12. The wellbore assembly includes a tubing string 14 having a lower end 14*a* and an upper end extending to surface (not shown). Tubing string 14 includes a plurality of spaced apart ported intervals 16*a* to 16*e* each including a plurality of ports 17 opened through the tubing string wall to permit access between the tubing string inner bore 18 and the wellbore.

A packer 20*a* is mounted between the upper-most ported interval 16*a* and the surface and further packers 20*b* to 20*e* are mounted between each pair of adjacent ported intervals. In the illustrated embodiment, a packer 20*f* is also mounted below the lower most ported interval 16*e* and lower end 14*a* of the tubing string. The packers are disposed about the tubing string and selected to seal the annulus between the tubing string and the wellbore wall, when the assembly is disposed in the wellbore. The packers divide the wellbore into isolated zones wherein fluid can be applied to one zone of the well, but is prevented from passing through the annulus into adjacent zones. As will be appreciated, the packers can be spaced in any way relative to the ported intervals to achieve a desired zone length or number of ported intervals per isolated zone. Packer 20*f* may take various forms depending on the operations that are to be carried out in the zones adjacent the packer. For example, this packer may be an anchor packer, if fracing out the toe, or an isolation packer, if the frac is to be carried out above. In addition, packer 20*f* need not be present in some applications.

The packers may be of various types. In this illustration, packers 20 are of the solid body-type with at least one extrudable packing element, for example, formed of rubber. Solid body packers including multiple, spaced apart packing elements 21*a*, 21*b* on a single packer are particularly useful especially for example in open hole (unlined wellbore) operations. In another embodiment, a plurality of packers is positioned in side-by-side relation on the tubing string, rather than using one packer between each ported interval.

Sliding sleeves 22*c* to 22*e* are disposed in the tubing string to control the opening of the ports. In this embodiment, a sliding sleeve is mounted over each ported interval to close the ports in that interval against fluid flow therethrough. However, each sleeve can be moved away from its position covering its port to open that port and allow fluid flow therethrough. In particular, each sliding sleeve is disposed to control the opening of its ported interval through the tubing string and each is moveable from a closed port position covering its associated ported interval (as shown by sleeves 22*c* and 22*d*) to an open port position away from its ports wherein fluid flow of, for example, stimulation fluid is permitted through its ports of the ported interval (as shown by sleeve 22*e*).

The assembly is run in and positioned downhole with the sliding sleeves each in their closed port position. The sleeves are moved to their open position when the tubing string is ready for use in fluid treatment of the wellbore. One or more isolated zones can be treated depending on the sleeves that are opened. For example, the sleeves for each isolated zone between adjacent packers may be opened individually to permit fluid flow to one wellbore segment at a time, in a staged, concentrated treatment process.

The sliding sleeves are each actuated by an actuator plug, such as balls 24*e*, 24*d*, which can be conveyed by gravity or fluid flow through the tubing string along a wireline, which in this embodiment is slickline 25. To actuate a sleeve, the actuator plug engages against the sleeve. In this case, ball 24*e* engages against sleeve 22*e*, and, when pressure is applied through the tubing string inner bore 18 from surface, ball 24*e* seats against and creates a pressure differential above and below the sleeve which drives the sleeve toward the lower pressure side.

In the illustrated embodiment, the inner surface of each sleeve which is open to the inner bore of the tubing string defines a seat 26*e* onto which an associated ball 24*e*, when launched from surface, can land and seal thereagainst. When the ball seals against the sleeve seat and pressure is applied or increased from surface, a pressure differential is set up which causes the sliding sleeve on which the ball has landed to slide to a port-open position. When the ports of the ported interval 16*e* are opened, fluid can flow therethrough to the annulus between the tubing string and the wellbore and, thereafter, into contact with formation 10.

Each of the plurality of sliding sleeves has a different diameter seat and therefore each accept different sized balls. In particular, the lower-most sliding sleeve 22*e* has the smallest diameter D1 seat and accepts the smallest sized ball 24*e* and each sleeve that is progressively closer to surface has a larger seat. For example, as shown in FIG. 1*b*, the sleeve 22*c* includes a seat 26*c* having a diameter D3, sleeve 22*d* includes a seat 26*d* having a diameter D2, which is less than D3 and sleeve 22*e* includes a seat 26*e* having a diameter D1, which is less than D2. This provides that the lowest sleeve can be actuated to open first by first launching the smallest ball 24*e*, which can pass though all of the seats of the sleeves closer to surface but which will land in and seal against seat 26*e* of sleeve 22*e*. Likewise, penultimate sleeve 22*d* can be actuated to move away from ported interval 16*d* by launching a ball 24*d* which is sized to pass through all of the seats closer to surface, including seat 26*c*, but which will land in and seal against seat 26*d*.

Each of the plurality of balls 24*e*, 24*d* can be conveyed along the slickline 25. Ball 24*e* for lowermost sleeve 22*e* can be fixed on the slickline and conveyed to its seat when running in line 25. Alternately, ball 24*e* can be moveable along the slickline. The subsequent balls can be conveyed by sliding along line 25. The balls may be installed such that they remain on the slickline and cannot pass off the end of the slickline. For example, an enlargement 29 may be installed at an end of the line such that any ball sliding along the wireline is stopped by the enlargement. In one embodiment, the ball closest the distal end of the line may be fixedly installed and therefore act as the enlargement.

Figure 2:
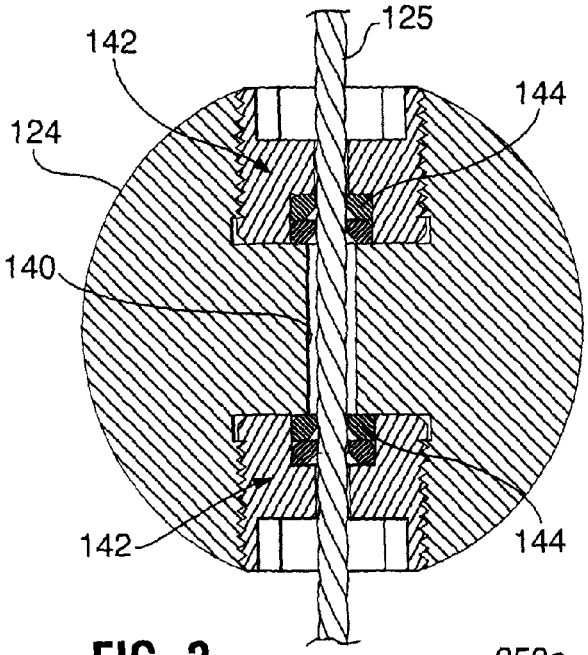
FIG. 2 is a sectional view through an actuator plug for tubing string port opening.

With reference to FIG. 2, a ball 124 is shown installed on a slickline 125. Ball 124 includes a hole 140 extending therethrough. Fittings 142, such as jamb nuts, may be positioned in the hole, for example in countersunk portions thereof, to line the hole at least on the ends and act as a guide for the line through the ball. Since ball 124 is intended to sufficiently hold pressure to ensure that the ball creates a seal in a seat of a sleeve, one or more seals 144 may be positioned to encircle the slickline, between the slickline and the ball to resist fluid flow through hole 140. Seals 144 may be carried on the ball, so that the seal stays in position between the ball and the slickline as the ball moves along the slickline. Seals 144 act between the ball and the slickline such that pressure can be held when the ball is sealing in its seat. A seal may for example include an O-ring or the like and need only seal against fluid flow in one direction through hole 140: downwardly therepast. In some embodiments, because the exterior surface of the slickline may be polished, a substantial seal may be accomplished between the ball and/or guide and the slickline even without seals.

The balls can be threaded onto the line and ride along it. However, the first ball conveyed need not ride along the wireline, as it can be installed in a fixed position on the line and can be conveyed to its seat by being carried on the wireline as it is run into the hole. In such an embodiment, the ball may be connected to the slickline 125 in various ways. However, for simplicity, a fixed ball may be installed on the wireline in a manner similar to that shown in FIG. 2, but with a connection between at least one fitting 142 and line 125.

Figure 3:
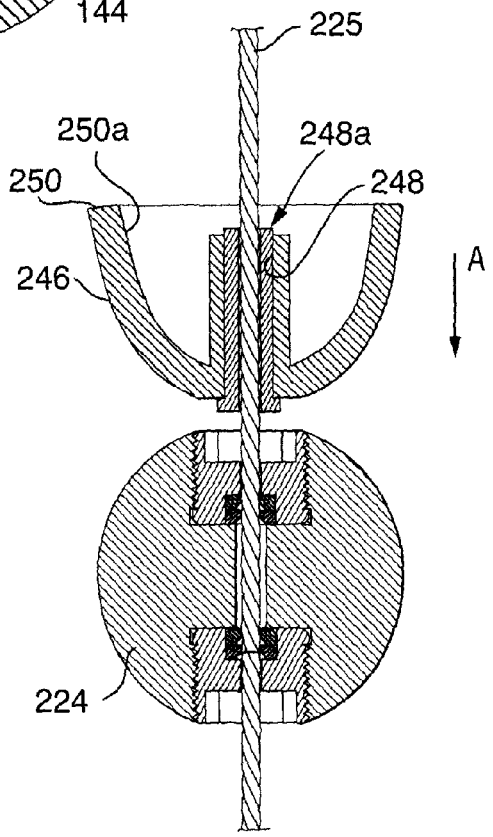
FIG. 3 is a sectional view of another actuator plug.

If one or more of the balls exhibit a detrimental resistance to moving along line 125, a sliding facilitator device may be installed on the wireline to assist the ball's movement along the line. For example, a smaller diameter ball may not easily slide along the slickline and may, therefore, fail, or take an unacceptably long time, to reach its seat. FIG. 3 shows a small diameter ball 224 threaded onto a slickline 225 and a sliding facilitator in the form of a fluid conveyed cup 246 also on the slickline. Fluid conveyed cup 246 includes a hole 248 through which it is threaded onto wireline 225 for sliding movement therealong. Hole 248 may be lined with a bushing 248*a* that resists wear by, and facilitates, movement along the slickline. Fluid conveyed cup 246 includes an upwardly cupped, and therefore upwardly acting, annular seal 250 that can catch fluid pressure against its concave side 250*a* and may be readily pushed along slickline 225, along direction of arrow A. Fluid conveyed cup 246 moves by fluid pressure applied against side 250*a* through the inner diameter of a tubing string to pull or push balls along the slickline. This may be particular useful in a horizontal or inclined section of the well or with smaller balls that do not develop sufficient fluid drive to overcome the frictional resistance to moving along a line.

A line deployment facilitator can also be employed to facilitate run in of line 225. For example, a fluid conveyed cup similar to that of FIG. 3 may be connected adjacent the distal end of line 225. To assist with wireline deployment, fluid conveyed cup 246 may be connected to, or act against a stop on, a line on which it is threaded. It is believed that a slickline can be pulled along a horizontal section by a flow of 5 barrels per minute using a fluid conveyed cup having a diameter to create a substantial seal with the tubing string inner diameter through which it is conveyed.

If desired, therefore, one or more fluid conveyed cups can be employed to move balls and/or to move the slickline, etc. and, as shown, with a ball or on its own to move the slickline.

Lower end 14*a* of the tubing string can be open, closed or fitted in various ways, depending on the operational characteristics of the tubing string, which are desired. As will be appreciated, an opening adjacent end 14*a* is required where fluid conductivity, as opposed to gravity, is needed to convey the wireline and the first ball to land in its sleeve. The opening may be created in various ways. In the illustrated embodiment, lower end 14*a* includes a pump out plug assembly 28. Pump out plug assembly 28 acts to close off end 14*a* during run in of the tubing string, to maintain the inner bore of the tubing string relatively clear. However, by application of fluid pressure, for example at a pressure of about 3000 psi, the plug can be blown out to permit actuation of the lower most sleeve 22*e* by generation of a pressure differential. Alternately, a sleeve that is hydraulically actuated may be provided to open a port adjacent end 14*a*. The sleeve may include a fluid actuated piston secured by shear pins, so that the sleeve can be opened remotely without the need to land a ball or plug therein. In other embodiments, not shown, end 14*a* can be left open or can be closed for example by installation of a welded or threaded plug.

While the illustrated tubing string includes five ported intervals, it is to be understood that any number of ported intervals could be used. In a fluid treatment assembly desired to be used for staged fluid treatment, at least two openable ports from the tubing string inner bore to the wellbore must be provided such as at least two ported intervals or an openable end and one ported interval. It is also to be understood that any number of ports can be used in each interval.

Centralizer 19 and other standard tubing string attachments can be used.

In use, the wellbore fluid treatment apparatus, as described with respect to FIGS. 1*a* and 1*b*, can be used in the fluid treatment of a wellbore. For selectively treating formation 10 through wellbore 12, the above-described tubing string assembly is run into the borehole and the packers are set to seal the annulus at each location creating a plurality of isolated annulus zones. Fluids can then be pumped down the tubing string and into a selected zone of the annulus, such as by increasing the pressure to pump out plug assembly 28. Alternately, a plurality of open ports or an open end can be provided or lower most sleeve can be hydraulically openable. Once that injectivity is achieved, ball 24*e* or another sealing plug is launched from surface and conveyed by gravity or fluid pressure on slickline to seal against seat 26*e* of the lower most sliding sleeve 22*e*. Slickline 25 can be run in first and ball 24*e* may be conveyed in along the slickline, once it is in place. Alternately, slickline 25 and the first ball 24*e* may be installed together. For example, the ball may be installed adjacent the end of the slickline and the slickline and the first ball may be run in together until ball 24*e* lands in its seat, at which point, slickline 25 is also known to be in position. When ball 24*e* lands it its seat 26*e*, this seals off the tubing string below sleeve 22*e* and opens ported interval 16*e*. This may allow this isolated zone (i.e. the zone between packer 20*e* and packer 20*f*) to be treated with fluid and/or the port can permit flow of production fluids therethrough. If injecting fluids, the treating fluids will be diverted through the ports of interval 16*e* that are exposed by moving the sliding sleeve and will be directed to a specific area of the formation. Ball 24*e* is sized to pass though all of the seats, including seats 26*c*, 26*d* closer to surface, without sealing thereagainst. Ball 24*e* remains on slickline 25 and can act to move the sleeve, while remaining on the slickline. When fluid treatment through ports 16*e* is complete, slickline 25 remains in place in the well and a ball 24*d* is launched that is sized to pass through all of the seats, including seat 26*c* closer to surface, and to seat in and move sleeve 22*d*. Ball 24*d* is also threaded on slickline 25 and slides along the slickline until it lands in its seat 22*d*, which stops the movement of the ball.

When ball 24*d* lands in its seat a pressure differential can be established across the ball and seat, which opens ported interval 16*d* and permits fluid treatment of the annulus between packers 20*d* and 20*e*. This process of launching progressively larger balls or plugs to move along slickline 25 to their seats is repeated until all of the zones of interest are treated. The balls can be launched without stopping the flow of treating fluids. After treatment, fluids can be shut in or flowed back immediately. Once fluid pressure is reduced from surface, any balls seated in sleeve seats can be unseated by pressure from below to permit fluid flow upwardly therethrough. This back flow may tend to push the balls back up along the slickline toward surface. However, to remove the balls 24*e*, 24*d*, slickline 25 can be pulled out of the hole, pulling all the balls with it. Thus, the removal of the balls can be very quick and reliable.

The apparatus is particularly useful for stimulation of a formation, using stimulation fluids, such as for example, acid, gelled acid, gelled water, gelled oil, $CO_2$, nitrogen and/or proppant laden fluids.

The first ball on the slickline may be the smallest sized ball 24*e*, sized to land in the lower-most sliding sleeve 22*e*, which has the smallest diameter D1 seat. That ball may be slid along the slickline, once the slickline is in place. Alternately, ball 24*e* may be installed adjacent the distal end of the slickline and conveyed downhole along with the slickline to land in its sleeve. The slickline, with or without the lowest ball attached, may be run in by gravity, by pushing the slickline in or by fluid conveyance. For example, a deployment facilitator, such as a fluid conveyed cup, can be employed on the slickline to improve fluid conveyance of the slickline through the tubing string, especially along a horizontal or inclined length of the string. The fluid conveyed cup may be formed to be acted upon by fluid pressure and may create a substantial seal to fluid passing thereby such that it is conveyed readily along the tubing string. As noted above, the fluid conveyed cup may resemble an upwardly acting cup packer. The fluid conveyed cup may pull the slickline behind it as the cup is pushed by fluid pressure. A fluid conveyed cup may alternately push or pull a ball on the slickline. More than one fluid conveyed cup may be employed. If pulling the slickline, the fluid conveyed cup may be secured in place, as by a connection or abutment against a stop, on the slickline. If pulling the ball, the fluid conveyed cup may be secured ahead of the ball and may be sized to pass through the sleeve onto which the ball is to land and seal. If pushing the ball, the fluid conveyed cup may ride along the wireline behind the ball.

The ball can be conveyed down to its sleeve, and when it arrives at the sleeve, it plugs the sleeve to shift it to the open position. This opens the port over which the sleeve acts as a valve. The ability is then achieved to inject into that zone or to simply allow fluid to be produced therethrough.

While the apparatus and method may be used to open only one sleeve, it may be particularly useful for opening a plurality of sleeves along a tubing string. According to this invention, after a first sleeve is opened by a ball carried on a slickline, further balls can be threaded onto the slickline, which is already in place extending through all the sleeves and the further balls can be conveyed downhole on the slickline to their respective sleeves. In particular, each further actuator ball may have a hole drilled therethrough such that it can be threaded onto and slide along the slickline. The further balls can then be dropped in sequence according to the sequence of sleeve sizes (lowermost to uppermost) to be actuated.

From small to large, the balls can be retained at surface and can be launched and injected one at a time. Injection can be made through a device such as an injection head that retains each ball and releases them one at a time down along the slickline. The slickline is in place and with injectivity, each ball follows the slickline all the way down until it lands on its sleeve and then shifts the sleeve to the open position. Thus, further ports along the tubing string can be opened one at a time.

The further balls may also be run along with cup devices, to facilitate their movement along the slickline, if desired. A fluid conveyed cup may push or pull a ball on the slickline, and moves along the slickline with the ball. More than one fluid conveyed cup may be employed. If pulling the ball, the fluid conveyed cup may be secured ahead of the ball and may be sized to pass through the sleeve onto which the ball is to land and seal. If pushing the ball, the fluid conveyed cup may be connected behind the ball directly or indirectly thereto. The fluid conveyed cup may include a passage therethrough through which the slickline can pass.

Each ball shifts only a sleeve with a valve seat sized to accept and create a seal with the ball. The ball will pass through all the sleeves with valve seats larger than it and the ball will stop only when a valve seat is reached through which the ball cannot pass or the end of the slickline is reached.

When it is desired to retrieve the balls out of the hole, the slickline can be pulled to surface with all of the balls attached. An enlargement on the slickline's distal end ensures that none of the slickline conveyed balls are freed. Therefore, removing balls from the hole may be readily accomplished. Thus when the last, uppermost port of interest is opened, the slickline can be pulled out and all the balls will come with it. Even if the slickline initially pulls up through the hole in a ball, the enlargement or the next ball on the line will come up and pick the ball up with the string. All the balls come out on the same line and there is no debris left in the well. Since the balls are progressively larger—bottom to top—they do not get hung up on the sleeves above.

As such, in a drilling campaign, a large number of wells can be drilled; strings installed and put on production quickly. Every port or selective ports can be opened rapidly without leaving debris in the well. Working from bottom to top, the sleeves can be opened after running in closed.

This is a mechanism to move all the sleeves of interest in a tubing string into the open position. Eventually it may be desirable to go in and close the sleeves again, for example, so that the well can be fraced in stages. If it is desired later on to move the sleeves to a closed position, those sleeves can be moved in various ways. For example, coil tubing can be run in with a shifting tool to shift the sleeves into the closed position. Alternately, a slickline process may be employed to close the sleeves, working from the top down. For example, the sleeves in the tubing string may be progressively smaller in diameter, with depth in the well. A sleeve shifting tool, for example, can include a connection to slickline and a latching mechanism. With slickline and a sleeve engaging tool, slickline can be run in, as by pumping, to locate the sleeve engaging tool down at the uppermost sleeve. Once the sleeve is engaged by the latching mechanism of the sleeve engaging tool, the slickline can be pulled up to pick up and pull the sleeve to the closed position. The tool can then disengage from that sleeve. In one embodiment, the sleeve shifting tool latching mechanism includes a plurality of engaging layers such as cylinders or shells or fingers. Once a shifting tool is used to shift a sleeve, it may release one of its layers, as by leaving the layer in the sleeve. The tool, then, assumes a slightly smaller diameter. The slickline can then be run with the smaller diameter tool to the next sleeve, locate there and pull up to close the sleeve. The process can be repeated until all the ports of interest are closed.

In another embodiment, e-line could be used with an electrically activated shifting tool that moves out a certain distance to engage the sleeve and move it to the closed position, but the use of a slickline solution is currently more cost effective.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A wellbore treatment apparatus comprising: a tubing string including a wall defining an inner diameter and a port extending through the wall, the port closed by a closure including a plug-actuated sliding sleeve; and a port opening apparatus including a wireline deployable through the inner diameter of the tubing string to extend to a position adjacent the plug-actuated sliding sleeve and an actuator plug carried on and axially slideable along the wireline, the actuator plug sized to land in the plug-actuated sliding sleeve to actuate the plug-actuated sliding sleeve, while remaining on the wireline.

2. The wellbore treatment apparatus of claim 1 wherein the actuator plug includes a hole therethrough through which the wireline passes to retain the actuator plug on the wireline, and the wireline passes through the hole as the actuator plug slides along the wireline.

3. The wellbore treatment apparatus of claim 2 further comprising a seal positioned in the hole between the wireline and the actuator plug to resist fluid flow through the hole.

4. The wellbore treatment apparatus of claim 1 wherein the tubing string has a long axis, a distal end, a second port opened through the wall of the tubing string, the second port offset from the port along the long axis of the tubing string closer to the distal end, a second closure including a second plug-actuated sliding sleeve and wherein the port opening apparatus includes a second actuator plug carried on the wireline, the second actuator plug being sized to land in and actuate the second plug-actuated sliding sleeve while remaining on the wireline.

5. The wellbore treatment apparatus of claim 4 wherein the second actuator plug is installed in a fixed position on the wireline.

6. The wellbore treatment apparatus of claim 4 wherein the second actuator plug is axially slideable along the wireline.

7. The wellbore treatment apparatus of claim 4 wherein the second actuator plug moves past the plug-actuated sliding sleeve without actuating the closure to open.

8. The wellbore treatment apparatus of claim 4 wherein a seat of the plug-actuated sliding sleeve has a larger diameter than a seat of the second plug-actuated sliding sleeve.

9. The wellbore treatment apparatus of claim 1 wherein the plug-actuated sliding sleeve seals against fluid flow through the port in a closed port position.

10. The wellbore treatment apparatus of claim 1 wherein the closure includes a subclosure sealing against fluid flow through the port and the plug-actuated sliding sleeve is movable to act against the subclosure to open the port.

11. The wellbore treatment apparatus of claim 1 wherein the tubing string carries a plurality of annular packers extending about the tubing string outer diameter, including a first packer operable to seal about the tubing string and mounted on the tubing string in a position offset from the port along a long axis of the tubing string and a second packer operable to seal about the tubing string and mounted on the tubing string on the other side of the port from the first packer.

12. The wellbore treatment apparatus of claim 1 wherein the wireline is slickline.

13. The wellbore treatment apparatus of claim 1 wherein the actuating plug is a ball.

14. The wellbore treatment apparatus of claim 1 wherein the port opening apparatus includes a sliding facilitator device installed on the wireline to assist movement of the actuator plug along the wireline.

15. The wellbore treatment apparatus of claim 14 wherein the sliding facilitator device is a fluid conveyed cup.

16. The wellbore treatment apparatus of claim 15 wherein the fluid conveyed cup pulls or pushes the actuator plug along the wireline.

17. The wellbore treatment apparatus of claim 1 further comprising a wireline deployment facilitator.

18. The wellbore treatment apparatus of claim 17 wherein the wireline deployment facilitator is a fluid conveyed cup connected on the wireline to apply a pulling force to the wireline when fluid pressure is applied to the fluid conveyed cup.

19. A method for fluid treatment of a wellbore lined with a tubing string including an inner diameter, a port and a closure including a sliding sleeve, the closure being in a closed port position over the port, the method comprising: running a wireline into the tubing string inner diameter to at least a position reaching the sliding sleeve; sliding an actuator plug along the wireline to land in the sliding sleeve such that the sliding sleeve is moved by the actuator plug landing therein to open the port; and forcing wellbore treatment fluid out through the port to treat the well.

20. The method of claim 19 wherein the fluid is one or more of acid, water, oil, $CO_2$ and nitrogen.

21. The method of claim 19 wherein the wellbore is an open hole or a cased hole.

22. The method of claim 19 further comprising setting packers about the tubing string to create isolated zones along an annulus about the tubing string.

23. The method of claim 19 further comprising removing the actuator plug including pulling the wireline out of the tubing string.

24. The method of claim 19 wherein running in the wireline includes pulling the wireline through the string by fluid pressure.

25. The method of claim 19 wherein sliding an actuator plug includes employing a fluid conveyed cup to ride along the wireline and push or pull the actuator plug.

26. A method for fluid treatment of a wellbore lined with a tubing string including an inner diameter, a port and a closure including a sliding sleeve, the closure being in a closed port position over the port, the method comprising: running a wireline into the tubing string inner diameter to at least a position reaching the sliding sleeve; conveying an actuator plug along the wireline to land in the sliding sleeve such that the sliding sleeve is moved by the actuator plug landing therein to open the port; forcing wellbore treatment fluid out through the port to treat the well; and conveying a second actuator plug to slide along the wireline to land in and shift a second sliding sleeve to open a second port uphole from the port.

27. The method of claim 26 wherein the actuator plug passes through the second sliding sleeve when being conveyed to the sliding sleeve.

28. The method of claim 26 wherein conveying the actuator plug moves the actuator plug from one position to another along the wireline.

29. The method of claim 26 wherein conveying includes sliding the actuator plug along the wireline.

* * * * *